US006454134B1

(12) United States Patent
Aujesky et al.

(10) Patent No.: US 6,454,134 B1
(45) Date of Patent: Sep. 24, 2002

(54) CONTAINER AND LOCK FOR A BAG FLUID FITTING

(75) Inventors: Jaromir K. Aujesky; J. W. (Bill) Spenceley, both of Lethbridge (CA)

(73) Assignee: Flexahopper Plastics Ltd., Lethbridge (CA)

( * ) Notice: Subject to any disclaimer, the term of this patent is extended or adjusted under 35 U.S.C. 154(b) by 0 days.

(21) Appl. No.: 09/494,424

(22) Filed: Jan. 31, 2000

(30) Foreign Application Priority Data

Mar. 10, 1999 (CA) ..... 2265057

(51) Int. Cl.[7] ..... B65D 35/56
(52) U.S. Cl. ..... 222/105; 222/183
(58) Field of Search ..... 222/105, 183

(56) References Cited

U.S. PATENT DOCUMENTS 3,233,817 A * 2/1966 Casady ..... 229/14
4,174,051 A * 11/1979 Edwards et al. ..... 222/105
4,919,306 A * 4/1990 Heaps, Jr. et al. ..... 222/105
4,960,227 A * 10/1990 Coleman ..... 222/94
5,176,294 A * 1/1993 Della Riva ..... 222/105
5,301,601 A * 4/1994 Cretors ..... 99/323.5
6,253,993 B1 * 7/2001 Lloyd et al. ..... 229/117.3

* cited by examiner

*Primary Examiner*—Lesley D. Morris
*Assistant Examiner*—Melvin A. Cartagena
(74) *Attorney, Agent, or Firm*—Sean W. Goodwin

(57) ABSTRACT

Locking apparatus is mounted to a wall or inside a bag-supporting container. The fluid-storage bag has a tubular fitting with axially spaced flanges forming an annular locking area. The locking apparatus comprises a diaphragm mounted over a port formed in the wall. The diaphragm has a opening formed therein which has a size and polygonal profile which matches the polygonal perimeter of the fitting's locking area. Cuts extending radially from the vertices of the polygonal opening form radial flaps. The outermost flange is larger than the diaphragm opening and when forcibly pushed through the diaphragm opening it deflects the flaps. Once the outermost flange passes axially through the flaps, the flaps snap back flexibly and engage the fittings locking area, resisting fitting removal. The complementary polygonal tubular perimeter and diaphragm opening resist rotation aiding in installation of threaded accessories. A removable plug is provided for installation to port outside of the wall which, when installed, seals any fluid within the walled enclosure.

23 Claims, 7 Drawing Sheets

Fig. 1b (PRIOR ART)
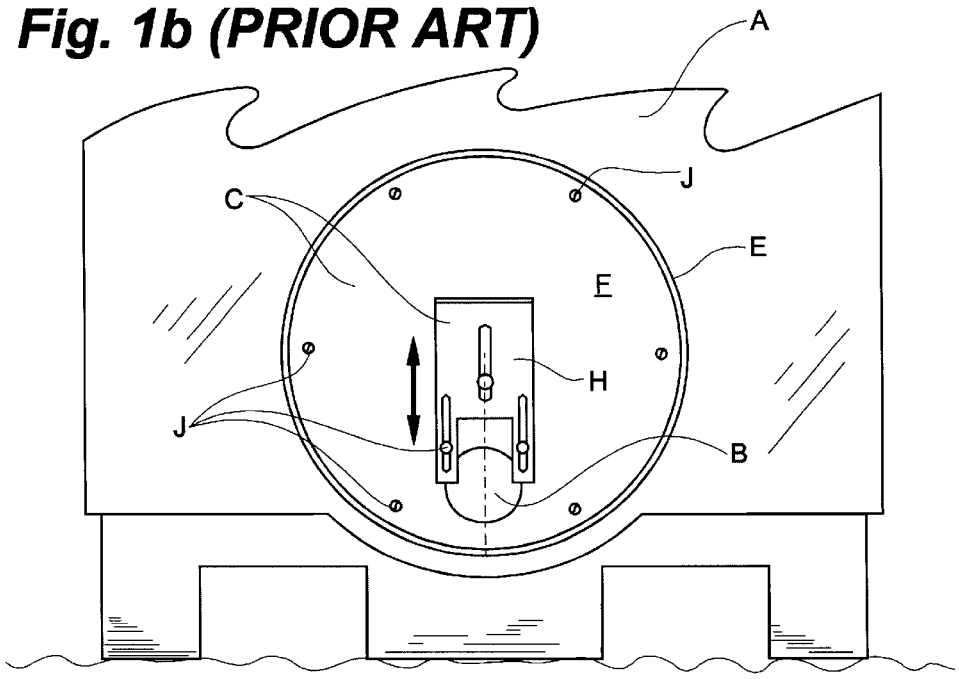
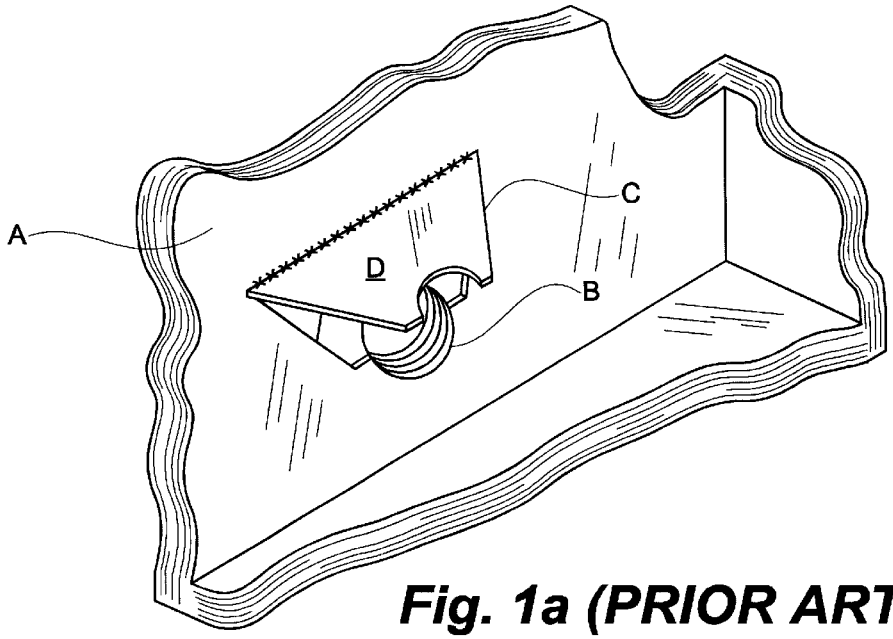
Fig. 1a (PRIOR ART)

1
3
4
11
13

6
8
19
20
23
25
26
27
28

CONTAINER AND LOCK FOR A BAG FLUID FITTING

FIELD OF THE INVENTION

The invention relates to apparatus for securing and leak proofing the spout or fluid fitting of a bag installed into a bag-supporting container.

BACKGROUND OF THE INVENTION

The food industry regularly stores of large volumes of liquid in plastic bags. The bags are not self-supporting and must be stored in structural containers.

The configuration of the bag is standard in the industry, such as supplied by Shieldpak of Munro, La., USA and comprises the enclosing bag itself having a rigid plastic outlet or fluid fitting secured to an orifice formed in the bag. The size of the storage containers and placement of the outlet port are designed to be complementary to match the bag and the fluid fitting.

More specifically, the fluid fitting comprises a substantially cylindrical tube having a threaded internal bore and a shaped exterior. The shaped exterior is regular and polygonal so that it can be braced against rotation. Accordingly, threaded output devices, such as a valve, may be threaded into the bore while means engage the exterior of the fluid fitting for holding it against rotation. Typically, the shaped exterior comprises abutments which form a rectangular cross-section.

First and second flanges are spaced axially along the axial portion of the fluid fitting, straddling the rectangular cross-section. The first flange is connected to the bag and is typically larger than the second flange, spaced axially outwards from the bag. The annular space between the flanges forms a locking area which is engaged by an appropriate complementary apparatus to temporarily restrict axial movement.

Several prior art containers are known as shown in FIGS. 1*a* and 1*b*. As shown in FIG. 1*a*, it is known to use a 3.5×3.5 foot square multi-ply corrugated cardboard box A to provide the structure for holding a large plastic bag (not shown). The box A has an outlet port B adjacent its bottom for accepting the bag's fluid fitting (not shown). The bag is placed into the interior of the box and the fluid fitting is inserted through the orifice B for access to the fitting from outside the container A. For restricting movement of the fitting once installed to the box, the cardboard container's orifice includes a rudimentary locking device C comprises an innermost corrugated cardboard layer hinged to form a locking flap D. When the flap D is pivoted open, the entire orifice B is available for insertion of the fluid fitting. When the flap D is pivoted closed it encroaches upon the orifice B, engaging the locking area of the fluid fitting and thereby resisting removal thereof.

The walls of the corrugated cardboard containers are formed of about eight layers of cardboard. It is the applicant's observations that:

- They are expensive, considering the cardboard containers are meant to be disposable;
- they are subject to liquid (such as rain) damage;
- the cardboard flap does not restrain the fluid fitting against torque (such as when installing a threaded valve); and
- should a bag rupture there is no containment of the spilled liquid.

As shown in prior art FIG. 1*b*, others have sought to rectify some of the difficulties associated with cardboard containers by utilizing a plastic receptacle or container A.

The known plastic containers are conventionally designed, but specific detail must be addressed in handling the fluid fitting orifice B. It is known to form an oversized orifice E in the lower portion of the container A for installation of a locking apparatus D. The locking apparatus D comprises a flange plate F installed to the oversize orifice E. The plate E has the fluid fitting orifice B formed therein through which the bag's fluid fitting is installed. A knife gate H, like a large upside-down "U", is vertically slidable for alternately engaging and disengaging the locking area of the fluid fitting.

The plate F is secured to the container with a plurality of bolts J. The sliding knife H is secured to the plate F with bolts J. Each bolt J protrudes into the bag containment volume of the container A. Further, each bolt J is radially spaced from the fitting orifice B so as to be unfortunately position the innermost end of the bolt to contact the bag itself and create a potential source of bag puncture.

For the known plastic container A described above, should a bag rupture, there is no containment of the released liquid. Liquid can flow out of the fitting orifice B and past the knife gate H.

There is therefore a demonstrated need for a container which has a simple means for securing the fitting, which does not threatening the bag's integrity, and which includes means for providing a tight storage container upon demand.

SUMMARY OF THE INVENTION

In a preferred embodiment of the invention, a locking apparatus is provided for mounting to a wall or inside a bag-supporting container. The locking apparatus comprises a diaphragm mounted over a port formed the container wall adjacent its bottom. The diaphragm has an opening formed therein. Two or more cuts extend radially from the opening to form radial flaps. The tubular fitting of a fluid-storage bag has axially spaced flanges forming an annular locking area. The outermost flange is larger than the diaphragm opening and when forcibly pushed through the diaphragm opening it deflects the flaps. Once the outermost flange passes axially through the flaps, the flaps snap back flexibly and engage the fittings locking area, resisting removal. Preferably, both the locking area's tubular perimeter is polygonal and the diaphragms opening is also correspondingly sized, the engagement of which further resists relative rotation.

In a broad aspect then, apparatus is provided for locking a bag fitting to a wall structure, the fitting having a tubular perimeter and first and second axially spaced flanges, the apparatus comprising:

- a flexible diaphragm positioned over a port in the wall structure, the diaphragm having a periphery which extends radially beyond the port, an opening having radial dimensions smaller than the radial dimension of the second flange, and two or more cuts extending radially from the opening for forming two or more radial flaps so that when the fitting's second flange is pressed forcibly against the flaps, the flaps flexibly deflect out of the plane of the diaphragm so as to permit passage of the second flange therethrough, the flaps then snapping back flexibly to engage the tubing's perimeter in the fitting's locking area; and
- fasteners for mounting the diaphragm's periphery to the wall structure so that the diaphragm and fitting are locked together and locked relative to the wall structure.

Preferably, the diaphragm opening and tubing perimeter have complementary polygonal profiles for resisting relative rotation. More preferably, the polygonal opening is slightly smaller than the locking area's polygonal profile so that the flaps remain slightly deflected when engaged, providing stronger resistance to axial removal.

Even more preferably, a plug is provided for the port outside of the wall which, when installed, seals any fluid within the walled enclosure.

BRIEF DESCRIPTION OF THE DRAWINGS

FIG. 1 is a partial front view of one type of fluid fitting locking apparatus of the prior art showing a large mounting plate and knife gate;

FIG. 8*a* is a side view, and FIG. 8*b* is a top view of the support without a fitting. FIG. 8*c* is a perspective view of the support with a fitting and elastic retainer supported thereon.

DETAILED DESCRIPTION OF THE PREFERRED EMBODIMENT

Figures 2A, 2B:
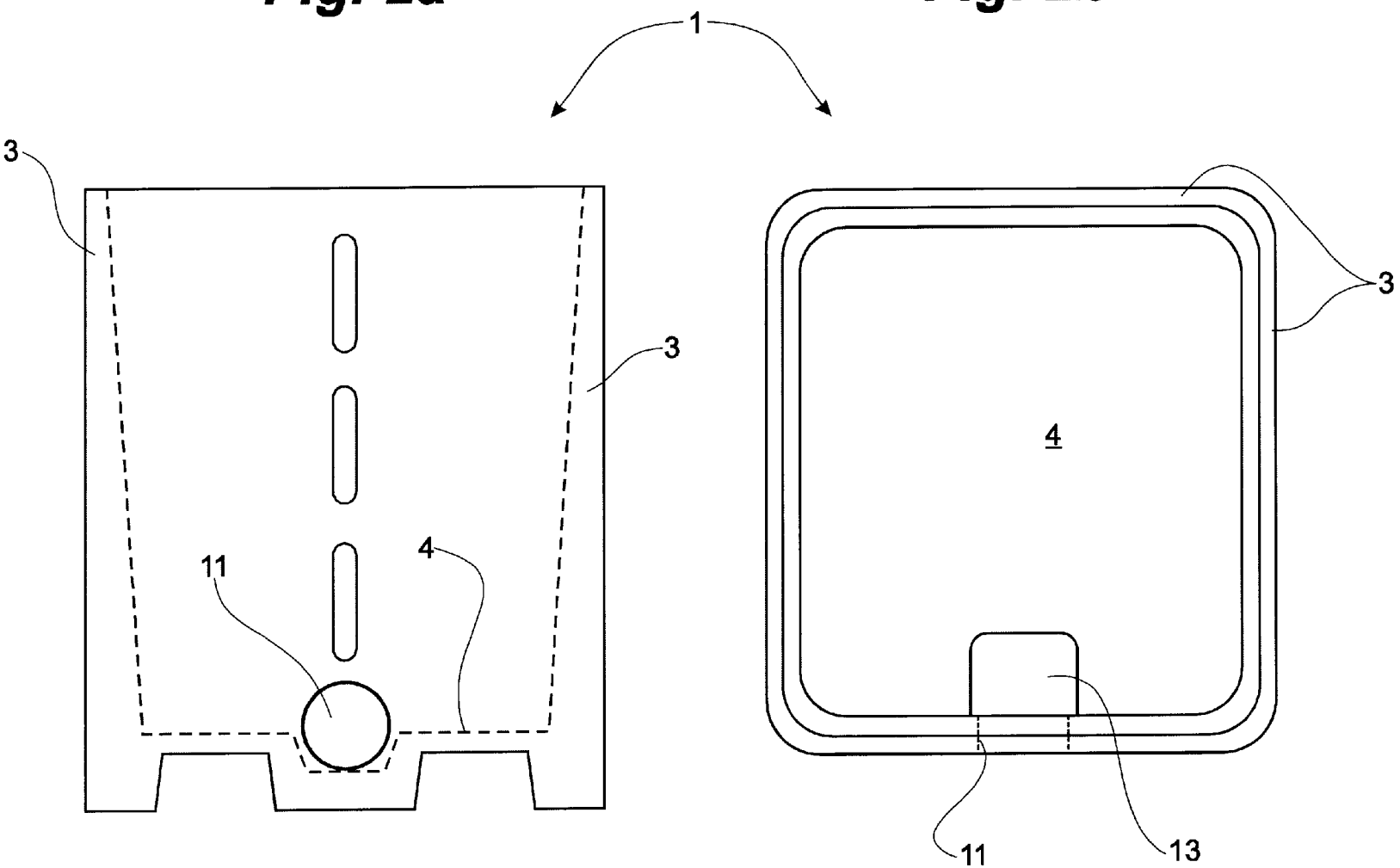
FIGS. 2*a* and 2*b* are a front and top view respectively of a container typical of that used for an implementation of the present invention.
Figure 3:
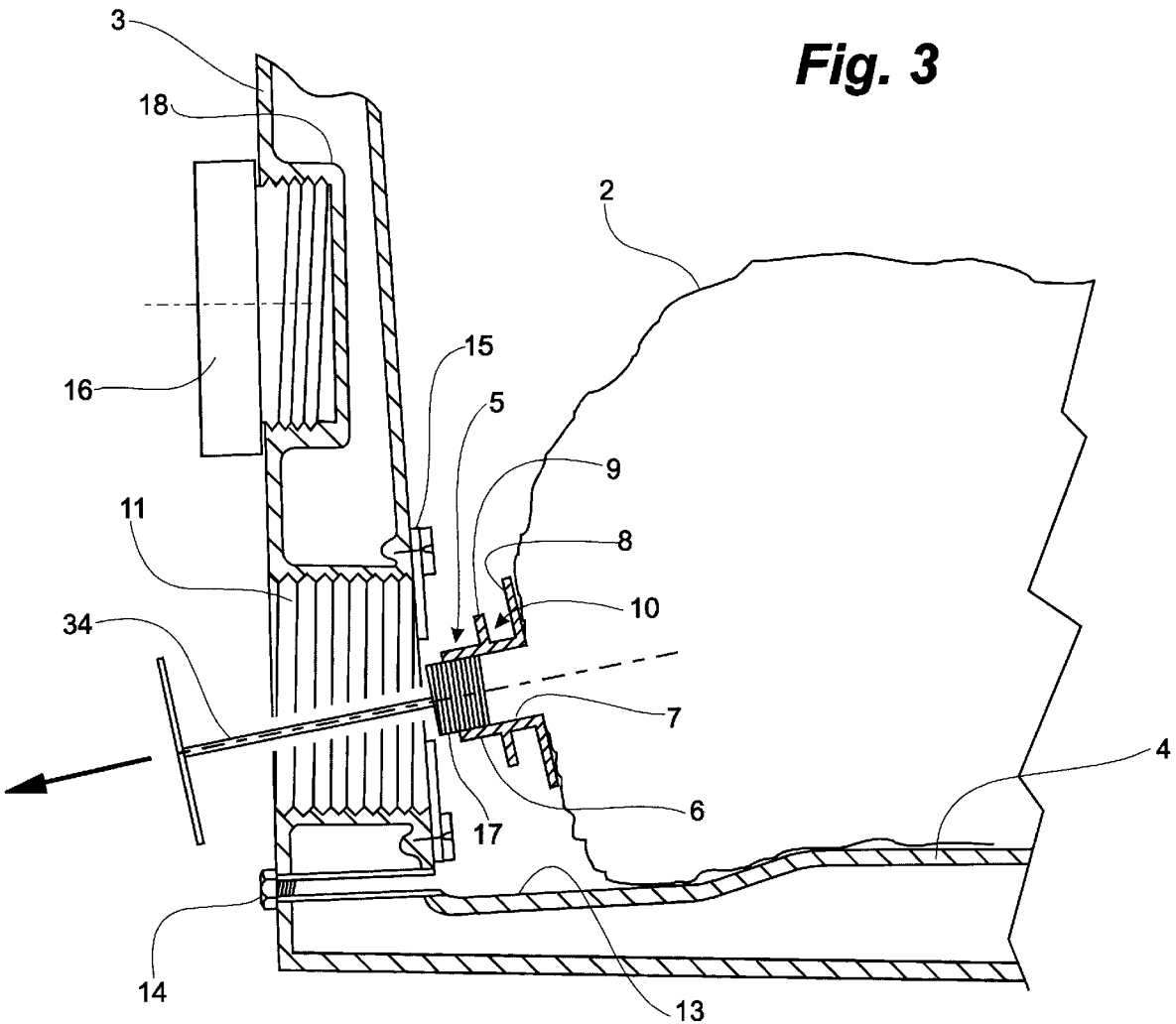
FIG. 3 is a partial cutaway view of a container, such as that of FIGS. 2*a*, 2*b*, in the process of having a bag installed into fitting-locking apparatus according to an embodiment of the present invention.

Having reference to FIGS. 2*a*, 2*b*, a rectangular plastic container 1 is provided for use in combination with and for supporting a conventional food grade plastic bag 2 (FIG.3). The container 1 has four upright walls 3 and a bottom 4. The container walls have thickness. The walls and bottom 4 of the container 1 are capable of containing liquid with, or without a bag 2. The container 1 is conveniently manufactured using rotation moulding or other techniques. Appropriate draft for the walls 3 is illustrated.

The bag (see FIG. 3) is fitted with a rigid spout or fluid fitting 5. The fitting 5 comprises cylindrical tubing 6 having a threaded internal bore 7 and a first flange 8 at the bag-end of the tube 6. The first flange 8, having a large load distributing diameter, is already secured to the bag 2 such as by plastic welding. The tubing 6 is connected to and protrudes outwardly from the bag 2. A second flange 9, smaller in diameter than the first flange 8, is spaced axially outwards along tubing 6 forming an annular space therebetween. In cross-section, the outside circumference or perimeter of the tubing 6, between the flanges 8,9, has a square cross-section or profile.

The annular area between the flanges 8,9 forms a locking area 10 for enabling restriction of the fitting's axial movement.

The tubing's perimeter in the fitting's locking area forms a square profile 19 for enabling restriction of the fitting's rotation about the axis of the tubing 6.

Figure 8A:
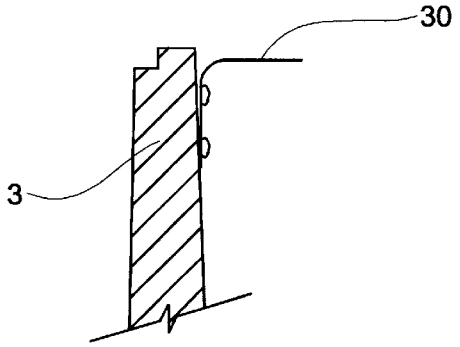
FIGS. 8*a*–8*c* illustrate the bag fitting support.
Figure 8B:
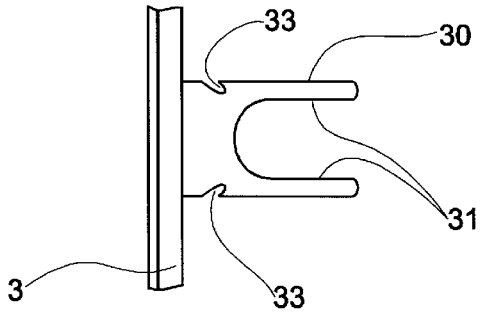
Figure 8C:
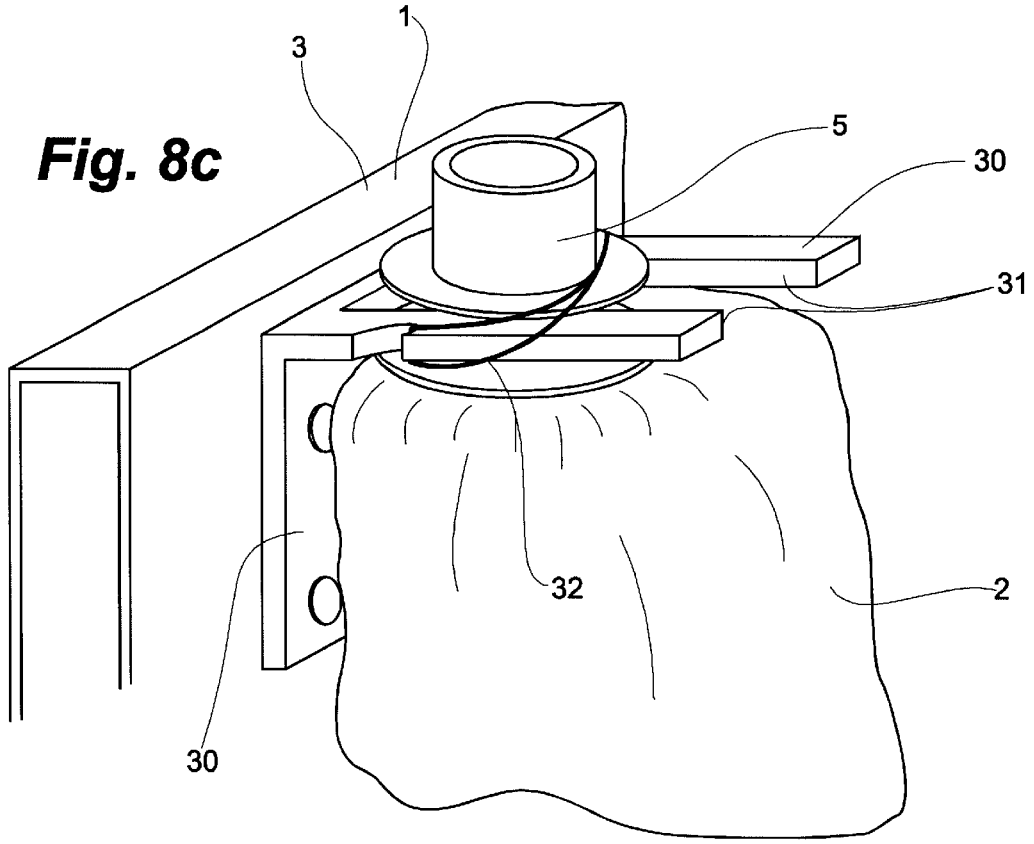

As shown in FIGS. 8*a*–8*c*, a bag fluid fitting support 30 is secured to the top edge of one wall 3. The support has a complementary rectangular profile 31 for engaging the locking area 10 of the fitting 5. In this way, the fitting 5 can be readily and conveniently secured for the pre-installation or removal of threaded devices (not shown) or liquid filling functions. For retaining the fluid fitting 5 to the support 30, an elastic retainer 32 is stretched about the fitting and hooked onto notches 33.

The container 1 has a substantially flat bottom 4. A liquid port 11 is located midway along one wall 3 and adjacent the container's bottom 4. A small depression or sump 13 is formed in the container bottom below the liquid port 11. The bottom 4 of the container is sloped slightly to encourage draining of the bag 2 to the sump 13. A small maintenance drain 14 is provided.

In one embodiment of the invention, the container's liquid port 11 is provided in combination with a fluid fitting-lock 15, and a liquid port plug 16. The bag fluid fitting 5 is installed into the port 11.

The liquid port 11 comprises a passage formed through the container wall 3. Due to the thickness of the walls 3, when installed, the bag's fluid fitting 5 remains within the wall 3.

A special T-bar fitting installation tool 34 is provided. A first end of the tool 34 comprises a fitting plug 17 compatible with the bore of the fitting 5. By screwing the T-bar's fitting plug 17 into tube 6, significant force can be applied to the T-shaped handle at the second end to pull the fluid fitting 5 into the fitting lock 15 as shown in FIG. 4.

Figure 4:
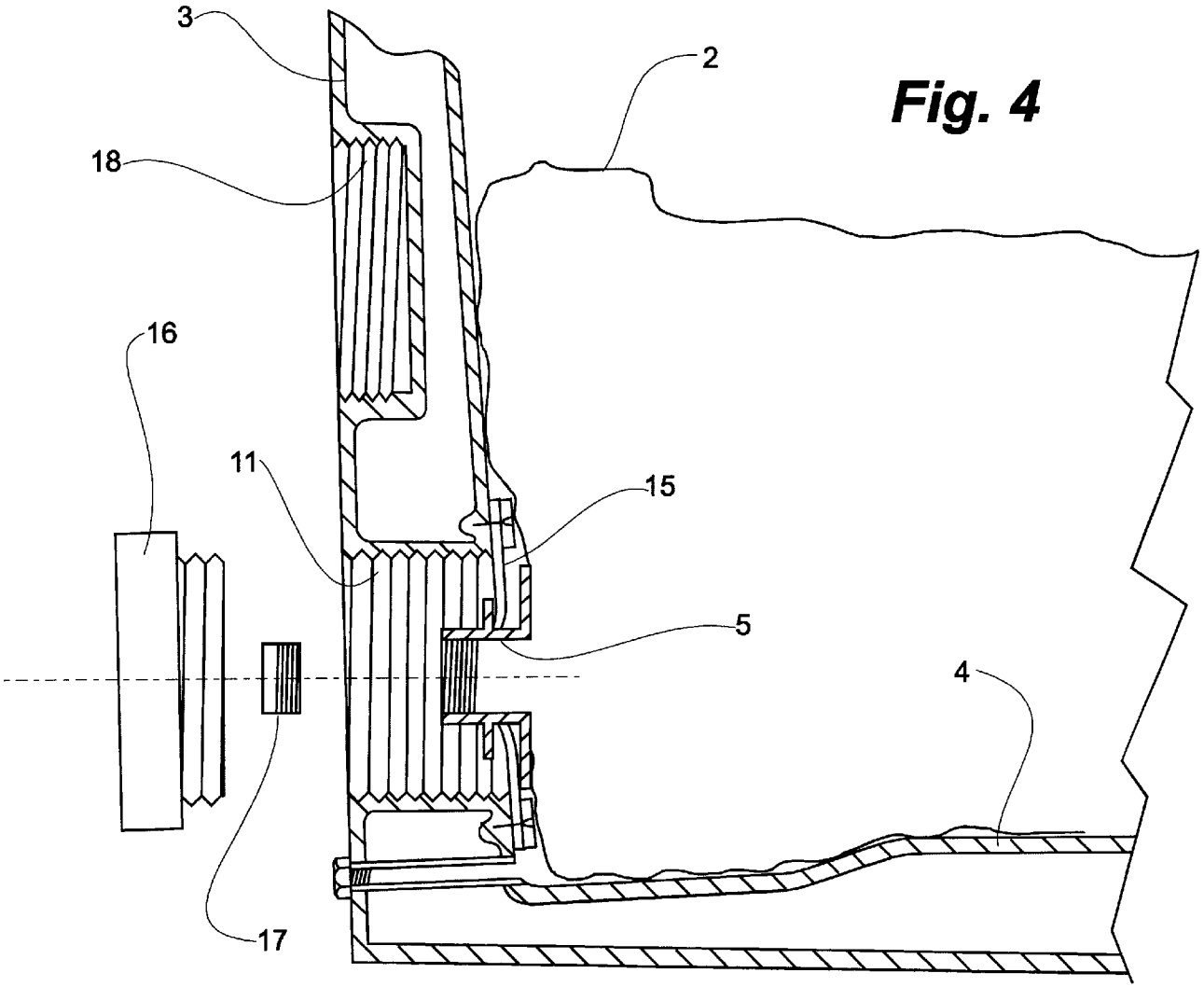
FIG. 4 is a partial cutaway view of a container according to FIG.3 illustrating the fluid fitting fully installed into the bag-fitting lock.

FIG. 4 further illustrates a conventional fitting plug 17 typically shipped with the bag. The fitting plug 17 retains liquid within the bag 2.

The liquid port plug 16 is threaded for installation into the liquid port 11. Should the bag 2 rupture, liquid can flow past the fitting lock 15. Accordingly, while liquid is not actively being accessed, the liquid port plug 16 is threaded into the port 11 for blocking fluid should the bag 2 rupture, such as during rough handling during shipment. The liquid plug 16 is storable in a threaded storage port 18.

Figure 5A:
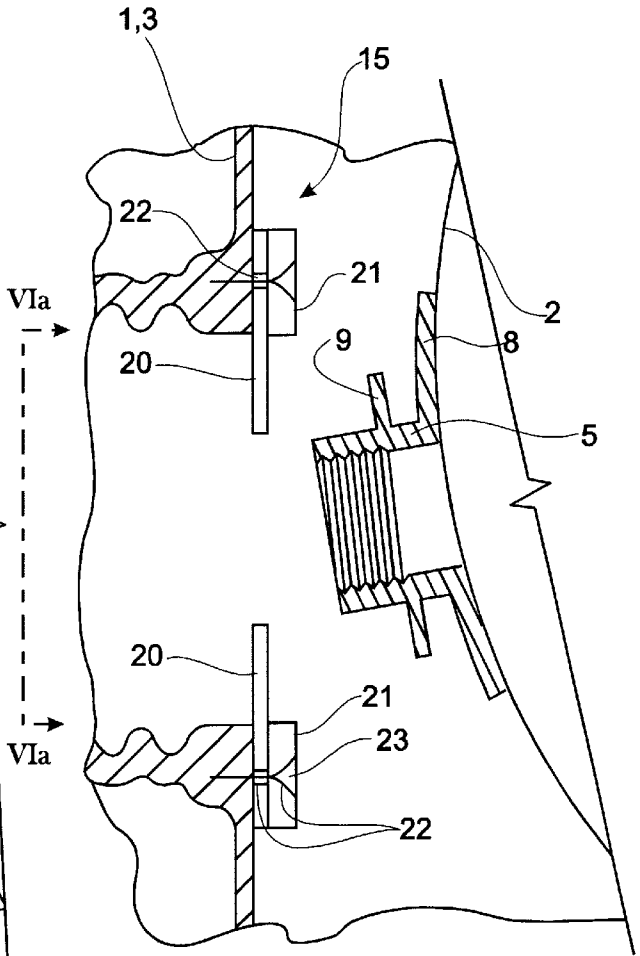
FIGS. 5*a*–5*c* are partial side cross-section views which illustrate the series of installation steps to place a fluid fitting into a bag-fitting lock.
Figure 5B:
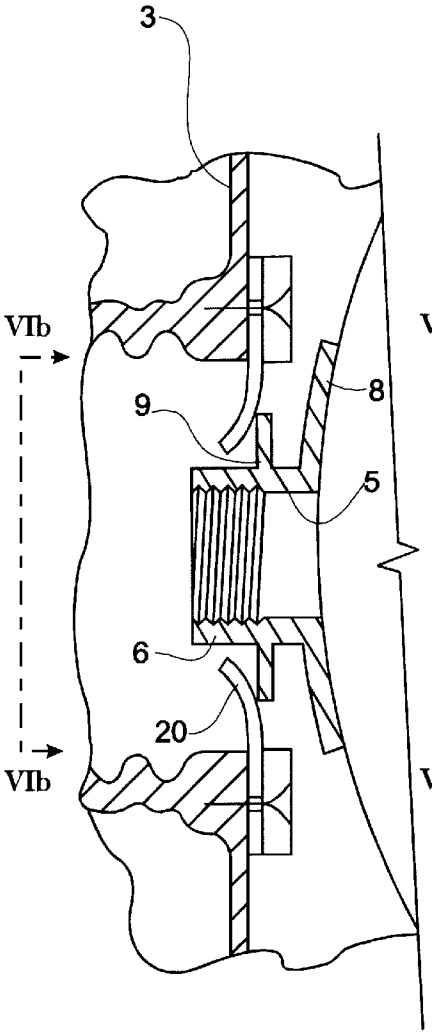
Figure 5C:
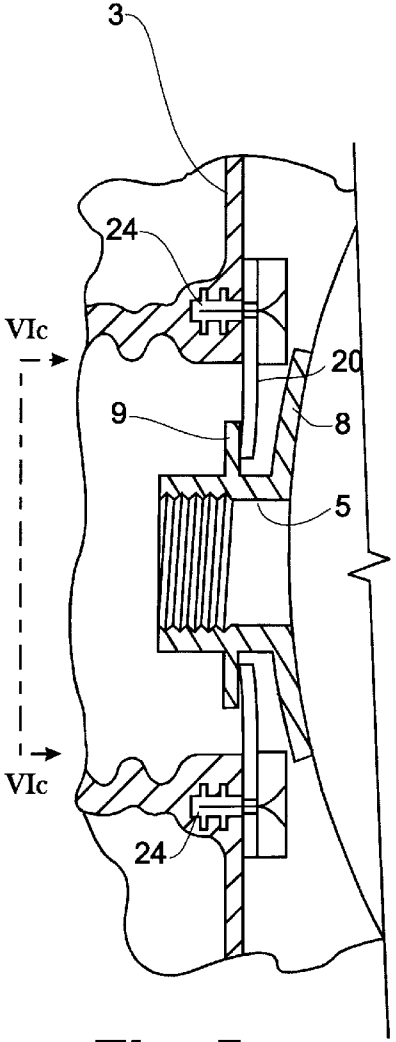

The fluid fitting lock 15 comprises a food grade flexible diaphragm 20 (FIG. 7) and a mounting ring 21 (FIGS. 5*a*–5*c*). Mounting holes 22 are formed in the mounting ring 21 and diaphragm 20 through which fasteners or screws 23 from the mounting ring 21 pass and extend into the container's wall 3. Best seen in FIG. 5*a*, steels inserts 24 are moulded into the container 1 for accepting the mounting screws 23. The screw holes 22 in the mounting ring 21 are counter-sunk or inset to permit the heads of the screw 23 to rest below the ring's surface and thus avoid projecting into the container and threaten the integrity of the bag 2.

The diaphragm 20 is formed of 3/16 inch thick, fibre-reinforced flexible food-grade rubber or synthetic. The diaphragm 20 is planer, has a circular 6.5 inch diameter outside periphery 25 and a 2.5×2.5 inch polygonal internal opening or profile 26 (square is shown). Each vertex of the polygonal internal profile 26 has 5/8 inch long cut 28 extending radially inward for forming flaps 27. Each flap 27 can be deflected out of the plane of the diaphragm 20 substantially independent of the other flaps 27. One flap 27 is provided for each face of the polygonal profile 19 in the locking area 10 and the internal profile 26. For the square profile 19,26 of the first embodiment, the diaphragm 20 has four flaps 27.

The diaphragm 20 resists in-plane deflection but the flaps 27 can be forcibly deflected perpendicular to the plane to permit installation of the fluid fitting.

Figures 6A, 6B, 6C, 7:
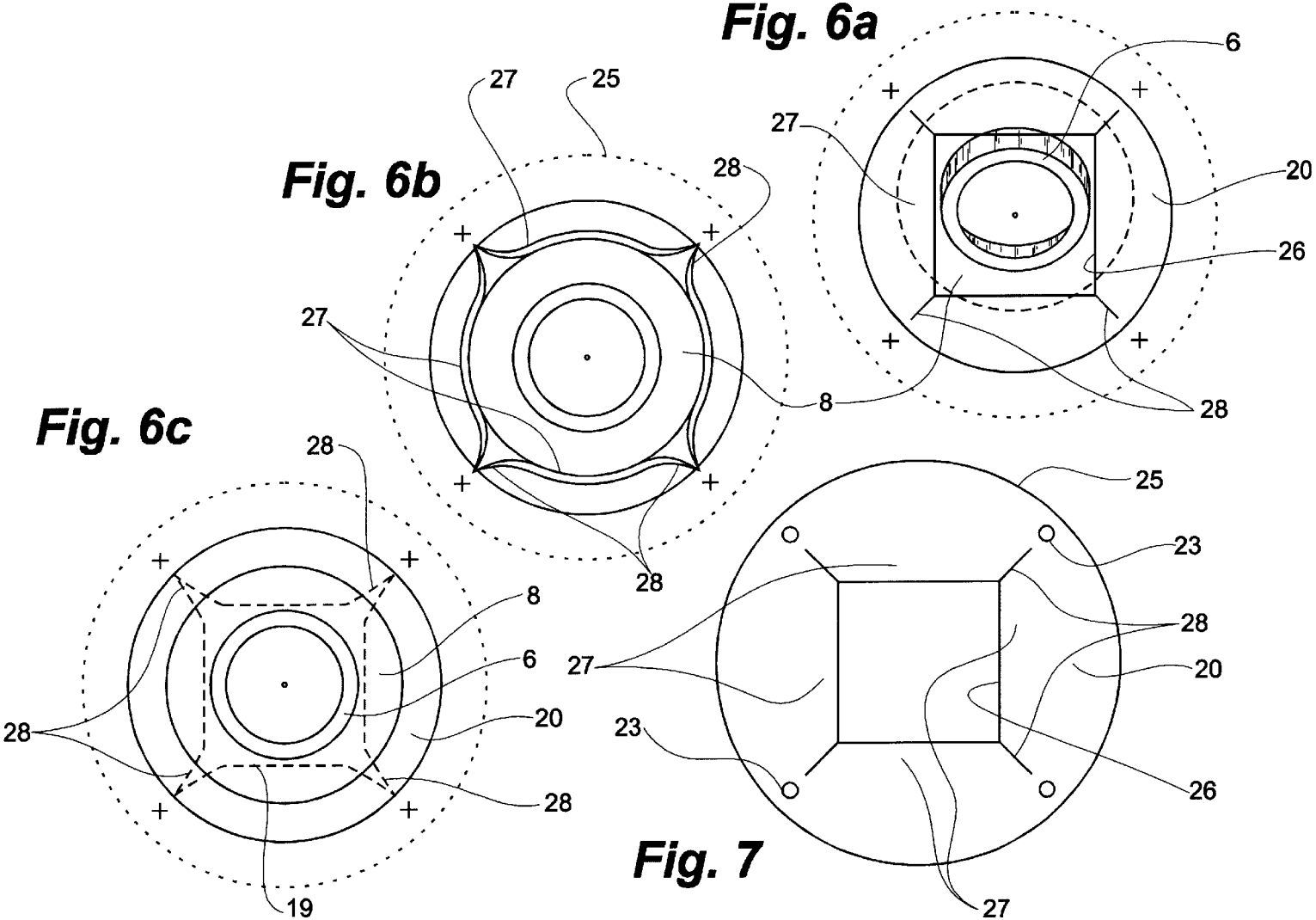
FIGS. 6*a*–6*c* are front views which correspond to FIGS. 5*a*–5*c* respectively and illustrate the installation of the fluid fitting into the bag-fitting lock.
FIG. 7 is the view of a bag filling support mounted to one wall of a bag container.

The size and polygonal exterior of the profile 19 of the fitting 5 (a square profile is shown in FIGS. 6*a*–6*c*) is complementary with the internal polygonal opening profile of the diaphragm 20. More preferably, the diaphragm profile is slightly smaller than the fitting profile. Accordingly, when the diaphragm profile engages the fitting profile, the diaphragm remains deflected outwardly slightly, thereby more strongly resisting inward movement or removal.

Further, when locked together, the fitting profile 19 resists rotation in the diaphragm 20, rotation requiring severe distortion to deflect the flaps 27. During threaded installation of a valve or other device to the fluid fitting 5, the flaps must deflect, buckle, then be forced out of the locking area 10 between the fitting's flanges 8,9.

Having reference to FIG. 3, for installing the bag's fluid fitting 5 to the fitting lock 15, it is convenient to use the T-bar 16 to pull the fitting 5 into the lock 15. Otherwise, the fitting 5 can be pushed into the lock 15 from within the container 1.

Turning to FIGS. 5*a*–5*c* and FIGS. 6*a*–6*c*, the stages of fitting installation are depicted, illustrating the action of the diaphragm 20 to installation.

In FIGS. 5*a* and 6*a*, the fitting 5 can be seen being advanced to the diaphragm 20 on a bit of an angle; angled more for visibility than any other reason. The diameter of the second flange 9 is larger than the relaxed polygonal opening 26. The second flange 9 is shown in hidden lines as an oval (due to the tilt depicted in FIG. 5*a*.

In FIGS. 5*b* and 6*b*, the second flange 9 is forcibly pressed axially against the flaps 27 of the diaphragm 20, causing them to deflect axially outwards and out of the way of the second flange to permit its passage therethrough.

In FIGS. 5*c* and 6*c*, the second flange 9 of the fitting 5 passes the flaps 27. The flaps 27 snap back flexibly into the locking area 10 between the fitting's first and second flanges 8,9. The profile 26 substantially regains its polygonal shape as shown in hidden lines. Having a slight size difference in their respective profiles, flaps 27 remains slightly loaded or deflected on the fitting's profile.

Although the above described embodiments are described with some specificity, there are other variations which are apparent to those of skill in the art. For example, the square profile could also be other polygons such as hexagonal, the container could be fabricated of metal, the fitting could be an assembly which is mechanically mounted to a flexible bag and the material of the diaphragm need not be of food grade, anticipating that even storage of hazardous liquids would be an advantageous application.

The embodiments of the invention for which an exclusive privilege or property is claimed are as follows:

1. Apparatus for locking a fluid fitting of a flexible bag in a port, the fluid fitting comprising:

tubing connected to and projecting from the bag, the tubing having a first flange adjacent the bag and a second flange spaced axially from the first flange for forming an annular locking area between the first and second flanges, the annular locking area having a polygonal perimeter;

a port formed in a wall of a fluid retaining container;

a flexible diaphragm having a periphery which has a diameter greater than the port, a polygonal opening complementary to the annular locking area having radial dimensions smaller than the radial dimension of the second flange, and two or more cuts extending radially from the opening for forming two or more radial flaps, so that when the fitting's second flange is pressed forcibly against the flaps, the flaps flexibly deflect out of the plane of the diaphragm so as to permit passage of the second flange therethrough, the flaps then snapping back flexibly to engage the fitting's polygonal locking area to the diaphragm's polygonal opening; and a ring for securing the diaphragm's periphery to the wall about the port.

2. The apparatus as described in claim 1 wherein the radial dimensions of the polygonal opening are substantially the same as the perimeter of the fitting's polygonal locking area so that the flaps engage the fitting and resist relative rotation.

3. The apparatus as described in claim 2 wherein the polygonal locking area and the polygonal opening in the diaphragm are square.

4. The apparatus as described in claim 1 wherein the fluid impervious container comprises walls and a bottom for containing the flexible bag and fluid leaking therefrom.

5. The apparatus as described in claim 4 wherein the port is formed in a wall adjacent the bottom of the container.

6. The apparatus as described in claim 4 wherein the walls have a thickness and the port is recessed into the thickness of the wall so as to maintain the fluid fitting within the wall.

7. The apparatus as described in claim 6 wherein the port is threaded so as to accept a threaded liquid port plug to prevent fluid from leaking out of the container should the flexible bag rupture.

8. The apparatus as described in claim 7 wherein the container further comprises a threaded recess formed in the thickness of the wall for retaining the threaded liquid port plug when not engaged in the port.

9. The apparatus as described in claim 4 wherein the container further comprises a maintenance drain located adjacent the bottom of the container and below the port, the drain having a removable cap.

10. The apparatus as described in claim 9 wherein the container further comprises a slope formed in the bottom of the container In the direction of the maintenance drain for forming a sump so as to encourage liquid which has leaked from the bag into the container to flow towards the drain.

11. The apparatus as described in claim 1 wherein the ring for securing the diaphragm's periphery to the wall about the port is secured to the wall using circumferenctially-spaced fasteners which pass through the ring and the diaphragm for securing to the wall.

12. The apparatus as described in claim 1 further comprising a T-bar fitting installation tool having a fitting plug compatible with a bore of the fitting at a first end and a T-shaped handle at a second end such that when the fitting plug is engaged in the bore of the fitting, sufficient force is applied to the handle to pull the second flange through the opening in the diaphragm engaging the fluid fitting into the locking apparatus.

13. A container for housing a flexible bag having a fluid fitting, the container comprising:

walls and a bottom for containing the bag and for containing any fluid therein;

aport formed in a wall adjacent the bottom of the containers the port having an inside wall and a bore, the bore accepting the fluid fitting connected to and projecting from the bag, the fluid fitting having a tubing having a first flange adjacent the bag and a second flange spaced axially from the first flange for forming a polygonal annular locking area between the first and second flanges for forming a locking apparatus;

a flexible diaphragm positioned concentrically over the port on one side of the wall, the diaphragm having a periphery which has a diameter greater than the port; a polygonal opening having radial dimensions smaller than the radial dimension of the second flange, and two or more cuts extending radially from the opening for forming two or more radial flaps, so that when the fitting's second flange is pressed forcibly against the flaps, the flaps flexibly deflect out of the plane of the diaphragm so as to permit passage of the second flange therethrough, the flaps then snapping back flexibly to engage the fitting's polygonal locking area to the diaphragm's polygonal opening; and a ring for securing the diaphragm's periphery to the wall about the port.

14. The container as described in claim 13 wherein the port is formed in a wall adjacent the bottom of the container.

15. The container as described in claim 14 wherein the container further comprises a maintenance drain located adjacent the bottom of the container and below the port, the drain having a removable cap.

16. The container as described in claim 15 wherein the container further comprises a slope formed in the bottom of the container in the direction of the maintenance drain for forming a sump so as to encourage liquid in the container to flow towards the drain.

17. The container as described in claim 13 wherein the walls have a thickness and the port is recessed into the thickness of the wall so as to maintain the fluid fitting within the wall.

18. The container as described in claim 17 wherein the container further comprises a threaded recess formed in the thickness of the wall for retaining the threaded liquid port plug when not engaged in the port.

19. The container as described in claim 13 wherein the port is threaded so as to accept a threaded liquid port plug to prevent fluid from leaking out of the container should the flexible bag rupture.

20. The container as described in claim 13 wherein the ring for securing the diaphragm's periphery to the wall about the port is secured to the wall using circumferentially-spaced fasteners which pass through the ring and the diaphragm for securing to the wall.

21. A method of locking a fluid fitting of a flexible bag into a fluid retaining container, the method comprising the steps of:

placing the flexible bag inside the fluid retaining container; and forcing a tubing, connected to and projecting from the bag, through a port in the container, the tubing having spaced first and second flanges forming a polygonal locking area therebetween, the port being fitted a flexible diaphragm having a periphery which has a diameter greater than the port, a polygonal opening complementary to the polygonal locking area having radial dimensions smaller than the radial dimension of the second flange, and two or more cuts extending radially from the opening for forming two or more radial flaps, so that when the fitting's second flange is pressed forcibly against the flaps, the flaps flexibly deflect out of the plane of the diaphragm so as to permit passage of the second flange therethrough, the flaps then snapping back flexibly to engage the fitting's polygonal locking area to the diaphragm's polygonal opening.

22. The method as described in claim 21 further comprising the step of threadably securing a plug in the port to fluidly seal the container from leaking fluid when not in service.

23. The method as described in claim 21 wherein the tubing is forced through the diaphragm using a T-fitting tool, the tool having a fitting plug at a first end and a T-shaped handle at a second end, the method further comprising the steps of:

passing the first end of the T-fitting tool through the port from an exterior to an interior;

securing the fitting plug to the fluid fitting; and pulling the fitting plug and fluid fitting through the port so as to engage the fitting's polygonal locking area to the diaphragm's polygonal opening.

* * * * *